United States Patent [19]

Petersson

[11] 4,275,998

[45] Jun. 30, 1981

[54] PISTON PUMP

[75] Inventor: Ralf C. E. Petersson, Hudiksvall, Sweden

[73] Assignee: Sundins Fabriker AB, Hudiksvall, Sweden

[21] Appl. No.: 69,115

[22] Filed: Aug. 23, 1979

[51] Int. Cl.[3] ..... F04B 1/18

[52] U.S. Cl. ..... 417/269

[58] Field of Search ..... 285/328; 417/269, 270

[56] References Cited

U.S. PATENT DOCUMENTS

| | | | |
|---|---|---|---|
| 1,819,966 | 8/1931 | Olson | 417/269 |
| 2,412,487 | 12/1946 | Ambey et al. | 285/328 |
| 2,570,698 | 10/1951 | Manseau | 417/269 |
| 3,214,201 | 10/1965 | Fonda | 285/363 |
| 3,258,281 | 6/1966 | Scott et al. | 285/328 |
| 3,411,453 | 11/1968 | Chanal | 417/269 |
| 3,981,630 | 9/1976 | Leduc | 417/269 |

FOREIGN PATENT DOCUMENTS

| | | | |
|---|---|---|---|
| 484114 | 5/1938 | United Kingdom | 417/269 |
| 533596 | 2/1941 | United Kingdom | 417/269 |

*Primary Examiner*—William L. Freeh

*Attorney, Agent, or Firm*—Harness, Dickey & Pierce

[57] ABSTRACT

An improved hydraulic piston pump of the kind provided with a tilting disk (22) which controls the displacements of the pistons (11). The improved pump has a compact construction and thus a low weight and it is able to operate at a very high rotational speed giving a very high output effect. These objects are achieved by providing the pump house (3) with borings (10) extending therethrough. These borings (10) house each their piston (11) and these pistons (11) are axially displaceable by means of a tilting disk (22). The inlet ends of the piston borings (10) are closed by means of a suction valve (13) of a special construction comprising for instance a washer (14) pressed into the piston boring (10). The other parts of the valve (13) are pressed against this washer (14) by the spring (12) which presses the piston (11) against the tilting disk (22). The rear cover (4) of the pump (1) is slightly conical such that when tightening the rear cover (4) against the pump house (3) there is obtained such an effective sealing that any risk for oil leaking has been eliminated and this in its turn makes it possible to manufacture the rear cover (4) from aluminium.

1 Claim, 3 Drawing Figures

PISTON PUMP

BACKGROUND OF THE INVENTION

This invention relates to an improved piston pump of the kind which comprises a pump house, a rear cover and a bearing housing. The pump house is provided with axial borings passing through the house and these borings house each a piston which is biassed by a spring and axially movable by the influence of a rocker disk being rotatingly fastened to a shaft. The rear cover is provided with a circular distribution channel for a hydraulic liquid and connection borings leading to the piston borings for feeding hydraulic liquid thereto, said piston borings being in communication with an outlet channel for the pressurized hydraulic liquid through borings in the cylinder block.

Piston pumps of this kind are used among other things to control cranes e.g. on trucks. The development in this technological field has required an ever increasing pressure and a more rapid function than could be obtained by hitherto known constructions. The subject invention has for its purpose also to minimize the number of parts of the pump such that the wearing is reduced and further the pump is made less complicated and less expensive in manufacture.

According to the invention there has been achieved a piston pump of the kind referred to hereabove which in order to eliminate the recited drawbacks is characterised thereby that arranged in the inlet to the piston boring is a suction valve, this valve comprising a washer which is pressed into the piston boring and which serves as a valve seat, and a valve disk pressed against said washer by a spring as well as a valve guide, this guide being pressed by the spring, acting on the piston, against the washer thereby that a second valve washer by a spring is pressed against the outlet of the connection channel to the outlet of pressurized hydraulic liquid, said second spring housed in a boring in the rear cover and guiding said second valve disk by cooperation with a pin on said second valve washer so as to shut last-mentioned boring, the rear cover being somewhat conically shaped at its surface turned against the block such that its central area will be pressed with the highest force against the end surface of the block.

In the piston pump according to the present invention there is thus not used any balls in the valves as in previous constructions, such balls causing drawbacks in having a higher mass than washers and disks and therefore reacting more slowly. Balls also act against valve seats with smaller surfaces than washers and disks with obvious drawbacks.

BRIEF DESCRIPTION OF THE DRAWINGS

These and other objects and advantages will become apparent from the following description with reference had to accompanying drawings. In the drawings.

DESCRIPTION OF THE PREFERRED EMBODIMENTS

Figure 1:
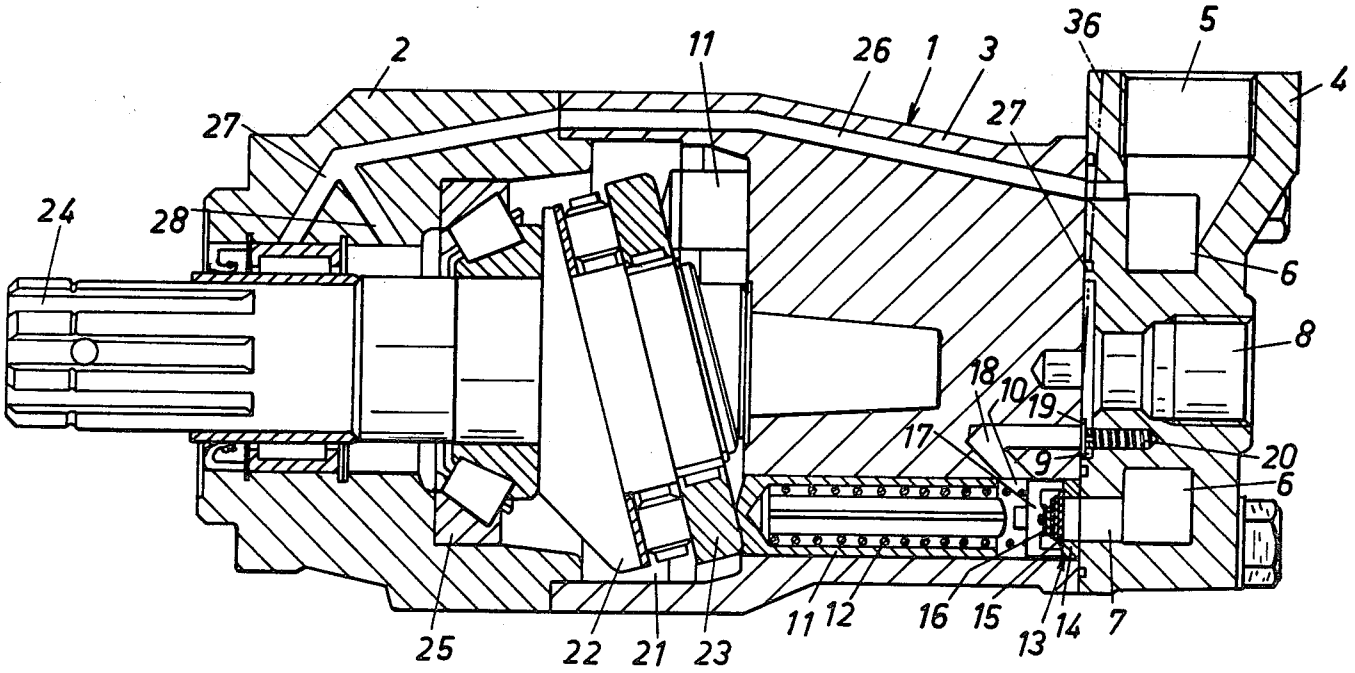
FIG. 1 shows an axial section through the pump according to the invention.

The piston pump 1 according to the invention comprises three main parts, viz. the bearing housing 2, the block 3 and the rear cover 4. The rear cover 4 has an inlet 5 for hydraulic liquid which from this inlet flows through a circular distribution channel 6. The channel 6 has inlets comprising axial borings 7 arranged along a circle. In the embodiment shown nine such borings 7 have been provided.

The rear cover 4 is also provided with an outlet 8 for pressurized hydraulic liquid and with connections 9 to this outlet 8 in the surface turned towards the block 3.

The block 3 is provided with a number of borings 10 extending therethrough, in the embodiment shown nine borings, in correspondence to the number of connection borings 7 from the distribution channel 6. Housed in each such boring 10 is an axially displaceable piston 11 which is influenced by a helical spring 12. A suction valve 13 is arranged in the end portion of the boring 10 turned towards the connection 9. This valve 13 comprises a washer 14 which has been pressed into the boring 10 and which forms the seat of a valve disk 15, this disk 15 being pressed against the washer 14 by a spring 16. A valve guide 17 keeps the spring 16 in its position and said guide 17 is in its turn pressed against the washer 14 by the spring 12.

A connection boring 18 extends from the boring 10 to the connection 9 and the mouth of the boring 18 can be closed by means of a valve disk 19 which by a spring 20, housed in a boring in the rear cover, is pressed towards a position to close the mouth of the boring 18. The spring 20 guides the movement of the disk 19 by means of a pin on the latter.

The block 3 is at its end turned away from the rear cover 4 provided with a wide boring 21 housing a tilting disk 22. The tilting disk 22 controls the movements of the pistons 11 under intermediary of a bearing 23. This control is obtained at the rotation of the shaft 24, on which the tilting disk 22 is mounted, the pistons 11 then being axially displaced in their borings 10 as will be explained in the following. The shaft 24 with the tilting disk 22 is journaled in a conical bearing 25.

It is to be noted that as shown in an exaggerated way by dash-and-dot-lines 36 the surface of the rear cover 4 turned towards the block 3 is slightly conical such that when tightened at the mounting of the rear cover the highest pressure is obtained at the centre of the pump which means that there is obtained absolute safety against oil leaking past the seal 27 which comprises a torus ring. Such a leaking has turned out to be fatal as it causes a break of the rear cover. Due to this conical shape it has even been possible to manufacture the rear cover 4 from aluminium which considerably reduces the weight of the pump and which also simplifies the manufacture of the pump and as a consequence thereof makes the pump cheaper.

The pump functions in the following manner. Assuming a piston 11 in the position shown in FIG. 1, the piston 11 at the rotation of the tilting disk is displaced to the left according to the drawing and this displacement creates a suction in the boring 10, causing the valve disk 15 to be lifted from its seat such that oil can stream or be sucked from the distribution channel 6 into the boring 10. Of course, the valve disk 19 is then, by the spring 20, pressed against the opening of the boring 18 to close the latter. At the continued rotation of the tilting disk 22 the lower piston 11—shown in section—when it has passed its end position—shown by means of the upper piston 11—is pressed to the right as viewed in the drawing and the valve disk 15 is then sealingly pressed against the washer 14 such that a pressure is created in the boring 10 and hydraulic liquid—oil—will be pressed through the boring 18 and lift the valve disk 19, against the action of the spring 20, from its closing position. Pressurized oil will then flow to the outlet 8.

Figure 2:
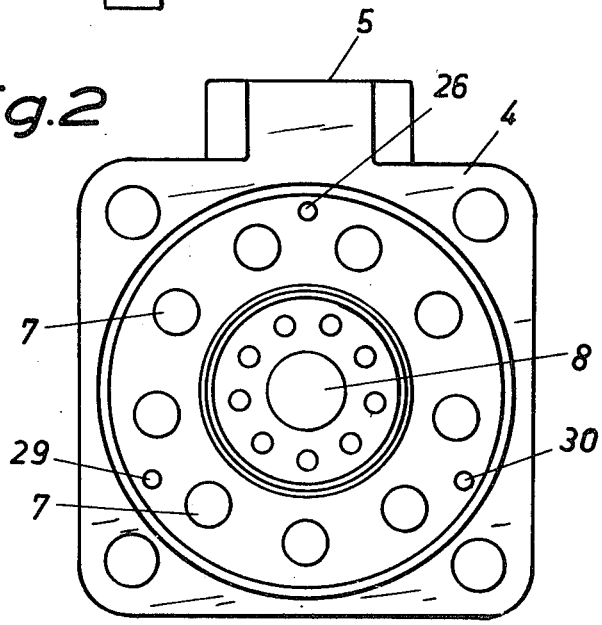
FIG. 2 is an end elevation of the rear cover of this pump.

At the rotation of the shaft 24, the conical bearing 25 generates a slight suction on the side turned towards the tilting disk 22. This suction is taken advantage of to cause oil to stream through the channel 26 which in the embodiment shown in the bearing housing 2 is branched into two outlet channels 27, 28 such that there is obtained on the one hand a lubrication of all moving parts and on the other hand a cooling which acutally lowers the temperature of the pump by 25° C. This lubricating oil is drained off through the borings 29, 30 which are indicated in FIG. 2.

The invention thus provides a light and efficient hydraulic pump in which by means of the insertion of the valve disk 14 by pressure as explained and the conical shape of the rear cover 4 any leaking of oil is effectively prevented.

Figure 3:
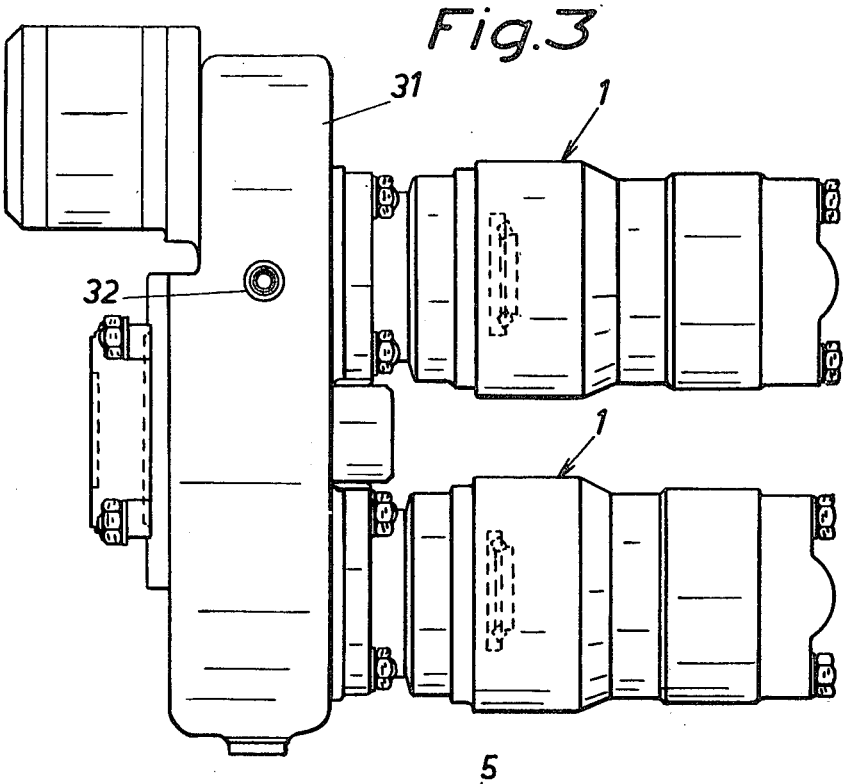
FIG. 3 is a plan view of two pumps according to the invention when coupled together by means of a gear.

There is shown in FIG. 3 how two pumps 1 may be coupled together by means of a gear 31 to double the pump effect. The gear 31 is of a construction known per se and need thus not be explained but it is to be observed that the gear 31 has a nipple 32 to be connected to an oil feeding hose such that the gear 31 as well as the pumps are lubricated with cooled oil in the way described. In other words, the pressure difference in the pumps 1 is taken advantage of to lubricate and cool also the gear.

The embodiments described are well suited to fulfil the objects aimed at but many modifications may be carried out without departure from the scope of the invention. Thus, the contacting surfaces may be treated in many different ways in order to obtain the desired sealing effect.

What I claim is:

1. An improved piston pump of the type comprising a pump housing having a plurality of axially extending cylinder bores therein, a rear cover affixed to one end of said pump housing and providing a closure for one end of said cylinder bores, a bearing housing affixed to the other end of said pump housing, a plurality of pistons each supported for reciprocation in a respective of said pump housing cylinder bores, a swash plate cooperable with said pistons for effecting reciprocation of said pistons upon rotation of said swash plate, a shaft journaled in said bearing housing and operative to drive said swash plate for reciprocation of said pistons upon rotation of said shaft, spring means positioned in said cylinder bores and urging said pistons into engagement with said swash plate, a fluid distribution channel formed in said rear cover, a plurality of inlet passages extending between said distribution channel and respective of said cylinder bores for communication of fluid to said cylinder bores, the improvement comprising a plurality of inlet valves means each interposed between a respective of said distribution passages and said cylinder bores, and a plurality of exhaust valve means each communicating a respective of said cylinder bores with an exhaust passage formed in said rear cover, said inlet valve means each comprising a washer press fitted into a respective of said cylinder bores contiguous to the said rear cover, a first disc type valve element associated with said washer for controlling the flow through the central opening of said washer, a spring retainer in said cylinder bore, said spring means in said cylinder bore bearing against said spring retainer for positioning said spring retainer in said cylinder bore and a first valve spring interposed between said spring retainer and said first disc type valve element for urging said first disc type valve element to its closed position, said exhaust valve means each comprising a valve bore positioned in said rear cover and terminating adjacent said pump housing, a discharge passage extending in said pump housng from said cylinder bore and terminating contiguous to said valve bore, a second disc type valve associated with said discharge passage and supported in said rear cover contiguous to said valve bore for controlling the flow through said discharge passage, a guide pin affixed to said second disc type valve and extending away from said discharge passage and into said valve bore, coil spring means positioned within said valve bore and encircling said guide pin and urging said second disc type valve into its closed position with said discharge passage, the surface of said rear cover engaging said pump housing being conical with its apex being disposed contiguous to the center of said pump housing for exerting a seal pressure against said pump housing when said rear cover is affixed thereto which is greatest at the center of said pump housing.

* * * * *